US010533750B2

(12) United States Patent
Garan et al.

(10) Patent No.: US 10,533,750 B2
(45) Date of Patent: Jan. 14, 2020

(54) CROSS IGNITION FLAME DUCT

(71) Applicant: SIEMENS AKTIENGESELLSCHAFT, München (DE)

(72) Inventors: Daniel W. Garan, Chuluota, FL (US); Richard L. Thackway, Oviedo, FL (US); David P. Holzapfel, Charlotte, NC (US); Stephen A. Ramier, Fredericton (CA); Charalambos Polyzopoulos, Orlando, FL (US); Kevin J. Spence, Winter Springs, FL (US); Joseph Scott Markovitz, Sanford, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 390 days.

(21) Appl. No.: 15/502,638

(22) PCT Filed: Sep. 5, 2014

(86) PCT No.: PCT/US2014/054173
§ 371 (c)(1),
(2) Date: Feb. 8, 2017

(87) PCT Pub. No.: WO2016/036377
PCT Pub. Date: Mar. 10, 2016

(65) Prior Publication Data

US 2017/0227228 A1 Aug. 10, 2017

(51) Int. Cl.

| | |
|---|---|
| ***F23R 3/48*** | (2006.01) |
| ***F23R 3/46*** | (2006.01) |
| *F23R 3/60* | (2006.01) |

(52) U.S. Cl.
CPC ..... *F23R 3/48* (2013.01); *F23R 3/46* (2013.01); *F23R 3/60* (2013.01)

(58) Field of Classification Search
CPC ..... F23R 3/48; F23R 3/60
See application file for complete search history.

(56) References Cited

U.S. PATENT DOCUMENTS

| | | |
|---|---|---|
| 2,437,385 A | 3/1948 | Halford |
| 3,570,241 A | 3/1971 | Alexander |

(Continued)

FOREIGN PATENT DOCUMENTS

| | | |
|---|---|---|
| EP | 1503144 A1 | 2/2005 |
| EP | 2128524 A1 | 12/2009 |

(Continued)

OTHER PUBLICATIONS

PCT International Search Report and Written Opinion dated May 11, 2015 corresponding to PCT Application No. PCT/US2014/054173 filed Sep. 5, 2014.

*Primary Examiner* — Todd E Manahan
*Assistant Examiner* — Katheryn A Malatek

(57) ABSTRACT

A cross-flame duct for connecting adjacent combustors together in a gas turbine to guard against flameout conditions within the combustors, whereby the cross-flame duct includes first and second ducts forming a slip joint to prevent stress from developing within the cross-flame duct is disclosed. The cross-flame duct remains flexible during turbine operation due to the slip joint, thereby preventing damaging thermal and mechanical stresses from developing within the cross-flame duct and enhancing the useful life of the cross-flame duct and associated components. The first and second ducts include cooling chambers positioned between outer sleeves and inner housings and maintained with one or more standoffs to reduce thermal stress and gradients or prevent material loss due to overheating or burning. The cooling (Continued)

chambers are supplied with cooling fluids via one or more fluid ports extending through the outer sleeves enabling air to flow through the cooling chambers and into the combustors.

16 Claims, 5 Drawing Sheets

(56) References Cited

U.S. PATENT DOCUMENTS

| | | | |
|---|---|---|---|
| 3,899,876 | A | 8/1975 | Williamson |
| 4,174,608 | A | 11/1979 | Hunyadi et al. |
| 4,763,481 | A | 8/1988 | Cannon |
| RE33,896 | E | 4/1992 | Maghon et al. |
| 5,987,875 | A | 11/1999 | Hilburn et al. |
| 6,220,015 | B1 | 4/2001 | Mina |
| 6,334,294 | B1 | 1/2002 | Belsom et al. |
| 6,408,628 | B1 | 6/2002 | Pidcock et al. |
| 6,484,505 | B1 | 11/2002 | Brown et al. |
| 6,705,088 | B2 | 3/2004 | Martling et al. |
| 6,718,773 | B2 | 4/2004 | Stalder et al. |
| 6,912,838 | B2 | 7/2005 | Sileo et al. |
| 6,966,187 | B2 | 11/2005 | Modi et al. |
| 7,007,477 | B2 | 3/2006 | Widener |
| 7,010,921 | B2 | 3/2006 | Intile et al. |
| 7,080,515 | B2 | 7/2006 | Wasif et al. |
| 7,412,833 | B2 | 8/2008 | Widener |
| 7,493,767 | B2 | 2/2009 | Bunker et al. |
| 7,665,309 | B2 | 2/2010 | Parker et al. |
| 7,762,074 | B2 | 7/2010 | Bland et al. |
| 8,096,133 | B2 | 1/2012 | Hessler et al. |
| 8,220,246 | B2 | 7/2012 | Widener |
| 8,307,657 | B2 | 11/2012 | Chila |
| 8,312,722 | B2 | 11/2012 | York et al. |
| 8,359,867 | B2 | 1/2013 | Chila et al. |
| 8,516,820 | B2 | 8/2013 | Ramier et al. |
| 8,607,569 | B2 | 12/2013 | Helmick et al. |
| 2005/0016178 | A1 | 1/2005 | Wasif et al. |
| 2007/0227148 | A1 | 10/2007 | Bland et al. |
| 2009/0071159 | A1 | 3/2009 | Parker et al. |
| 2010/0018209 | A1 | 1/2010 | Ramier et al. |
| 2010/0223931 | A1 | 9/2010 | Chila et al. |
| 2011/0067406 | A1* | 3/2011 | Widener ..... F23R 3/48 60/754 |
| 2011/0263285 | A1 | 10/2011 | Kronander et al. |
| 2012/0047900 | A1 | 3/2012 | Böttcher et al. |
| 2012/0137691 | A1 | 6/2012 | Böttcher et al. |
| 2013/0074501 | A1 | 3/2013 | Tiwary et al. |
| 2013/0074946 | A1 | 3/2013 | Ramier et al. |
| 2014/0130502 | A1 | 5/2014 | Böttcher et al. |
| 2014/0137536 | A1 | 5/2014 | Cloninger et al. |
| 2014/0144122 | A1 | 5/2014 | Overby et al. |

FOREIGN PATENT DOCUMENTS

| | | | |
|---|---|---|---|
| GB | 2003554 | A | 3/1979 |
| JP | S5714126 | A | 1/1982 |
| JP | S58168822 | A | 10/1983 |
| RU | 2159347 | C1 | 11/2000 |

* cited by examiner

CROSS IGNITION FLAME DUCT

FIELD OF THE INVENTION

The invention relates generally to gas turbines, and more particularly, to cross-flame ducts that extend between adjacent gas turbine combustors.

BACKGROUND

A gas turbine combustor typically includes a plurality of circumferentially arranged combustors within a combustor shell and surrounding a turbine rotor. At start-up, ignition is established in the fuel/air mixtures of certain combustors that include igniters, thereby creating a flame. As certain combustors may not include igniters, cross-flame tubes are used to connect the combustors. The cross-flame tubes carry the flame from combustor to combustor around the combustor array until a flame has been established in all of the combustors. Flame detectors in the combustors opposite those with igniters may be used to verify that a flame has been established in each combustor. During operation, the cross-flame tubes act to re-establish combustion in any combustor that may experience a flame-out.

Traditionally, the cross-flame tubes were formed from a flexible metal hose having flanges at each end. The flexible material may be used to compensate for assembly tolerances and a sliding fit between components of the tube may be designed to accommodate differential thermal growth. These designs however are susceptible to thermal and mechanical stresses that result in component fatigue and operational failures. It is therefore desirable to provide an improved cross-flame tube that addresses the thermal and mechanical limitations of prior art designs.

SUMMARY OF THE INVENTION

A cross-flame duct for connecting adjacent combustors together in a gas turbine to guard against flameout conditions within the combustors, whereby the cross-flame duct may include first and second ducts forming a slip joint to prevent stress from developing within the cross-flame duct is disclosed. The cross-flame duct remains flexible during turbine operation due to the slip joint, thereby preventing damaging thermal and mechanical stresses from developing within the cross-flame duct and enhancing the useful life of the cross-flame duct and associated components. The first and second ducts may also include cooling chambers positioned between outer sleeves and inner housings and maintained with one or more standoffs to reduce thermal stress and gradients or prevent material loss due to overheating or burning. The cooling chambers may be supplied with cooling fluids via one or more fluid ports extending through the outer sleeves enabling air to flow through the cooling chambers and into the combustors.

In at least one embodiment, the cross-flame duct for connecting adjacent combustors in a gas turbine engine may be formed from a first duct extending along a longitudinal axis and configured to be coupled to a first combustor. The first duct may be formed from a first outer sleeve having a first end configured to be coupled to the first combustor and a second end on an opposite end from the first end. The first duct may also include a first inner housing positioned within the first outer sleeve and having a first end adjacent the first combustor and a second end extending from the second end of the first outer sleeve. A first cooling chamber may be positioned between an outer surface of the first inner housing and an inner surface of the first outer sleeve. The cross-flame duct may also be include a second duct extending along the longitudinal axis and configured to be coupled to a second combustor, wherein the second duct is configured to slidably receive the first duct. The second duct may include a second outer sleeve having a first end configured to be coupled to the second combustor and extending toward the first duct to slidably receive the second end of the first inner housing within a second end of the second outer sleeve. The second duct may include a second inner housing positioned within the second outer sleeve and having a first end adjacent the second combustor and a second end extending toward the second end of the second outer sleeve. The second duct may also include a second cooling chamber positioned between an outer surface of the second inner housing and an inner surface of the second outer sleeve.

A first standoff may be positioned between the outer surface of the first inner housing and the inner surface of the first outer sleeve to maintain the first cooling chamber, and a second standoff may be positioned between the outer surface of the second inner housing and the inner surface of the second outer sleeve to maintain the second cooling chamber. A first fluid port may be positioned in the first outer sleeve adjacent to the first standoff to allow fluid to flow between the first cooling chamber and an environment exterior to the first outer sleeve. A second fluid port may be positioned in the second outer sleeve adjacent to the second standoff to allow fluid to flow between the second cooling chamber and an environment exterior to the second outer sleeve.

In at least one embodiment, a third cooling chamber may be positioned between the outer surface of the first inner housing and the inner surface of the second outer sleeve, and a third standoff may be positioned between the outer surface of the first inner housing and the inner surface of the second outer sleeve. The third standoff may separate the second outer sleeve from the first inner housing to maintain and enable the first duct to slides relative to the second duct. In at least one embodiment, the third standoff may be formed from a plurality radially projecting dimples configured to slidably engage an adjacent surface.

The first outer sleeve may be formed from a first flange positioned at the first end of the first outer sleeve, and the second outer sleeve may include a second flange positioned at the second end of the second outer sleeve. The first flange may be configured to be coupled to a first combustor flange of the first combustor and the second flange may be to be coupled to a second combustor flange of the second combustor. The first flange may have an outer diameter that is less than an outer diameter of the first combustor flange. The first end of the first inner housing may extend along the longitudinal axis toward the first combustor outwardly beyond the first end of the first outer sleeve.

The cross-flame duct may include one or more first standoffs positioned between the first inner housing and the first outer sleeve to maintain the first cooling chamber. The second standoff may be positioned between the second inner housing and the second outer sleeve to maintain the second cooling chamber and a third cooling chamber. The second cooling chamber may extend between the first end of the second inner housing and the second standoff. The third cooling chamber may extend between the second end of the second inner housing and the second standoff.

In another embodiment, the cross-flame duct may include a first duct extending along a longitudinal axis and configured to be coupled to a first combustor. The first duct may include a first outer sleeve having a first end configured to be coupled to the first combustor and a second end on an opposite end from the first end. The first duct may also include a first inner housing positioned within the first outer sleeve and having a first end adjacent the first combustor and a second end on an opposite end from the first end. The first duct may include a first cooling chamber positioned between an outer surface of the first inner housing and an inner surface of the first outer sleeve. The cross-flame duct may include a second duct extending along the longitudinal axis and configured to be coupled to a second combustor. The second duct may be configured to slidably receive the first duct and may include a second outer sleeve having a first end configured to be coupled to the second combustor and extending toward the first duct to slidably receive the second end of the first inner housing within a second end of the second outer sleeve. The second duct may include a second inner housing positioned within the second outer sleeve and having a first end adjacent the second combustor and a second end on an opposite end from the first end. The second duct may include a second cooling chamber positioned between an outer surface of the second inner housing and an inner surface of the second outer sleeve.

The cross-flame duct may also include a third duct formed from a first end slidably coupled to the second end of the first duct and a second end slidably coupled to the second end of the second duct. The third duct may form a middle duct between the first and second ducts of the cross-flame duct.

The second end of the first outer sleeve may extend beyond the second end of the first inner housing and may be configured to receive the first end of the third duct. The second end of the second outer sleeve may extend beyond the second end of the second inner housing and may be configured to receive the second end of the third duct. A third cooling chamber may be positioned between an outer surface of the third duct and an inner surface of the first outer sleeve. A fourth cooling chamber may be positioned between the outer surface of the third duct and the inner surface of the second outer sleeve. A fluid port may be positioned in the third duct and in fluid communication with the third cooling chamber, thereby placing the third cooling chamber in fluid communication with an environment external to the third duct. A fluid port may also be positioned in the third duct and in fluid communication with the fourth cooling chamber, thereby placing the fourth cooling chamber in fluid communication with the environment external to the third duct.

A first standoff may be positioned between the outer surface of the first inner housing and the inner surface of the first outer sleeve to maintain the first cooling chamber. A second standoff may be positioned between the outer surface of the second inner housing and the inner surface of the second outer sleeve to maintain the second cooling chamber. The cross-flame duct may also include a third standoff and a fourth standoff. The third standoff may be positioned between the outer surface of the third duct and the inner surface of the first outer sleeve to maintain the third cooling chamber. The fourth standoff may be positioned between the outer surface of the third duct and the inner surface of the second outer sleeve to maintain the fourth cooling chamber. In at least one embodiment, the third standoff and the fourth standoff may each include a plurality of radially projecting dimples positioned at the first end and second end of the third duct.

The cross-flame duct may include a position control system for limiting movement of the third duct relative to the first and second ducts. The third duct may be floatable between the first and second ducts between a first longitudinal position and a second longitudinal position, whereby a length of the third cooling chamber taken along the longitudinal axis and a length of the fourth cooling chamber taken along the longitudinal axis increase and decrease as the third duct floats between the first and the second longitudinal positions. The first outer sleeve may include a first flange positioned at the first end of the first outer sleeve, and the second outer sleeve may include a second flange positioned at the first end of the second outer sleeve. The first flange may be configured to be coupled to a first combustor flange of the first combustor, and the second flange may be configured to be coupled to a second combustor flange of the second combustor. The first flange may have an outer diameter that is less than an outer diameter of the first combustor flange.

The cross-flame duct may include a first fluid port positioned in the first outer sleeve adjacent to the first standoff to allow fluid to flow into the first cooling chamber from an environment exterior to the first outer sleeve. A second fluid port may be positioned in the second outer sleeve adjacent to the second standoff to allow fluid to flow into the second cooling chamber from an environment exterior to the second outer sleeve. The first end of the third duct may be configured to receive the second end of the first outer sleeve, and the second end of the third duct may be configured to receive the second end of the second outer sleeve.

The cross-flame duct may include a first standoff positioned between the outer surface of the first inner housing and the inner surface of the first outer sleeve to maintain the first cooling chamber. A second standoff may be positioned between the outer surface of the second inner housing and the inner surface of the second outer sleeve to maintain the second cooling chamber. A third cooling chamber may be positioned between the third duct and the first outer sleeve with a third standoff positioned between an inner surface of the third duct and an outer surface of the first outer sleeve in the third cooling chamber to maintain the third cooling chamber. A fourth cooling chamber may be positioned between the third duct and the second outer sleeve with a fourth standoff positioned between the inner surface of the third duct and an outer surface of the second outer sleeve in the fourth cooling chamber to maintain the fourth cooling chamber. The third standoff may include a plurality of radially projecting dimples positioned within the third cooling chamber and a plurality of radially projecting ridges extending circumferentially within the third cooling chamber. Fluid ports may be positioned between the plurality of radially projecting ridges to provide a fluid pathway between the third cooling chamber and an environment exterior to the first outer sleeve.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1A:
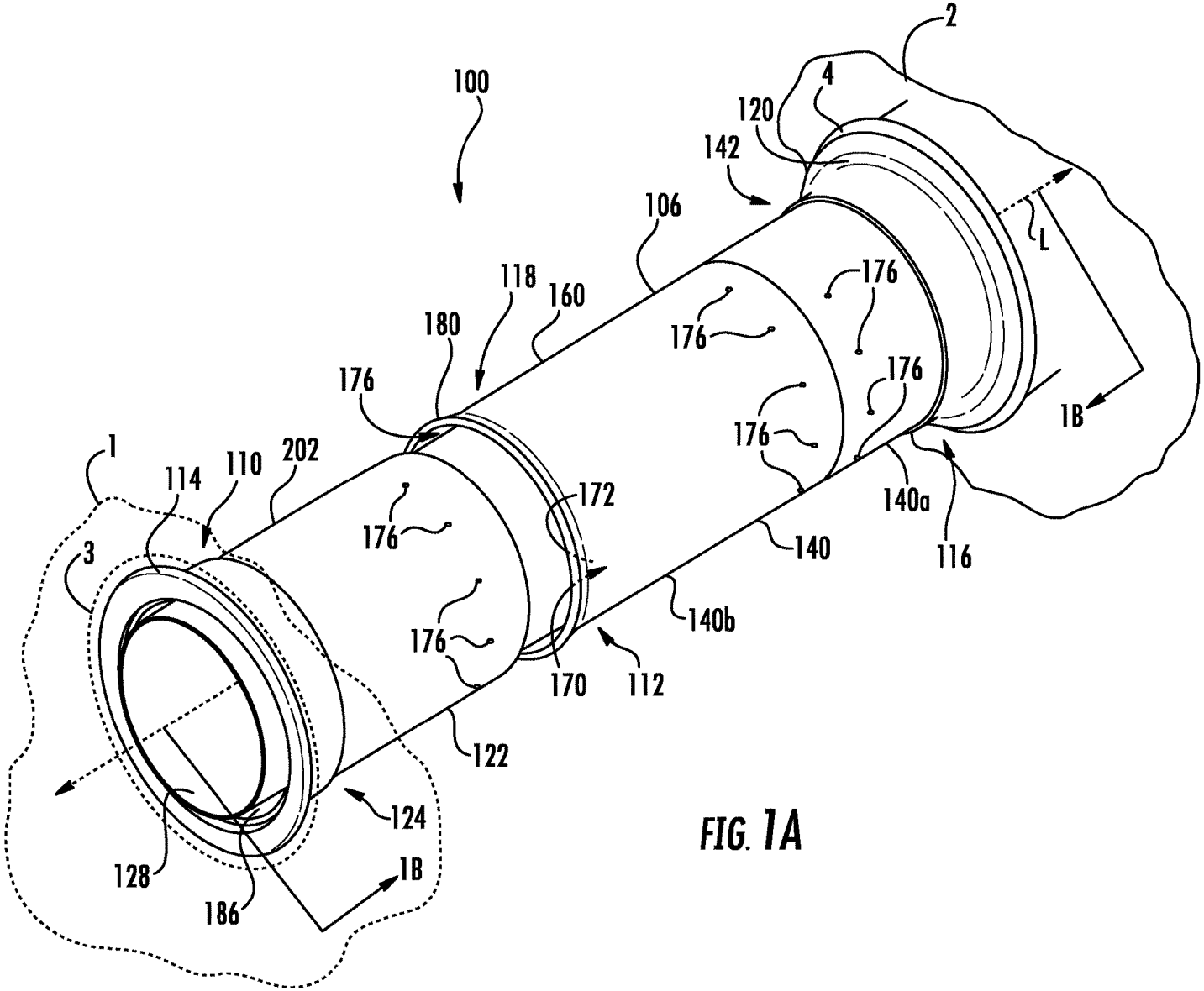
FIG. 1A is a perspective view of one embodiment of a cross-flame duct according to various embodiments described herein.

As shown in FIGS. 1A-3, a cross-flame duct 100 for connecting adjacent combustors 1, 2, together in a gas turbine to guard against flameout conditions within the combustors 1, 2, whereby the cross-flame duct 100 may include first and second ducts 102, 106 forming a slip joint to prevent stress from developing within the cross-flame duct 100 is disclosed. The cross-flame duct 100 may remain flexible during turbine operation due to the slip joint, thereby preventing damaging thermal and mechanical stresses from developing within the cross-flame duct 100 and enhancing the useful life of the cross-flame duct 100 and associated components. The first and second ducts 102, 106 may also include cooling chambers 138, 156, 174 positioned between outer sleeves 122, 140 and inner housings 128, 146 and maintained with one or more standoffs 134, 152, 170 to reduce thermal stress and gradients or prevent material loss due to overheating or burning. The cooling chambers 138, 156, 174 may be supplied with cooling fluids via one or more fluid ports 176 extending through the outer sleeves 122, 140 enabling air to flow through the cooling chambers 138, 156, 174 and into the combustors 1, 2.

Figure 1B:
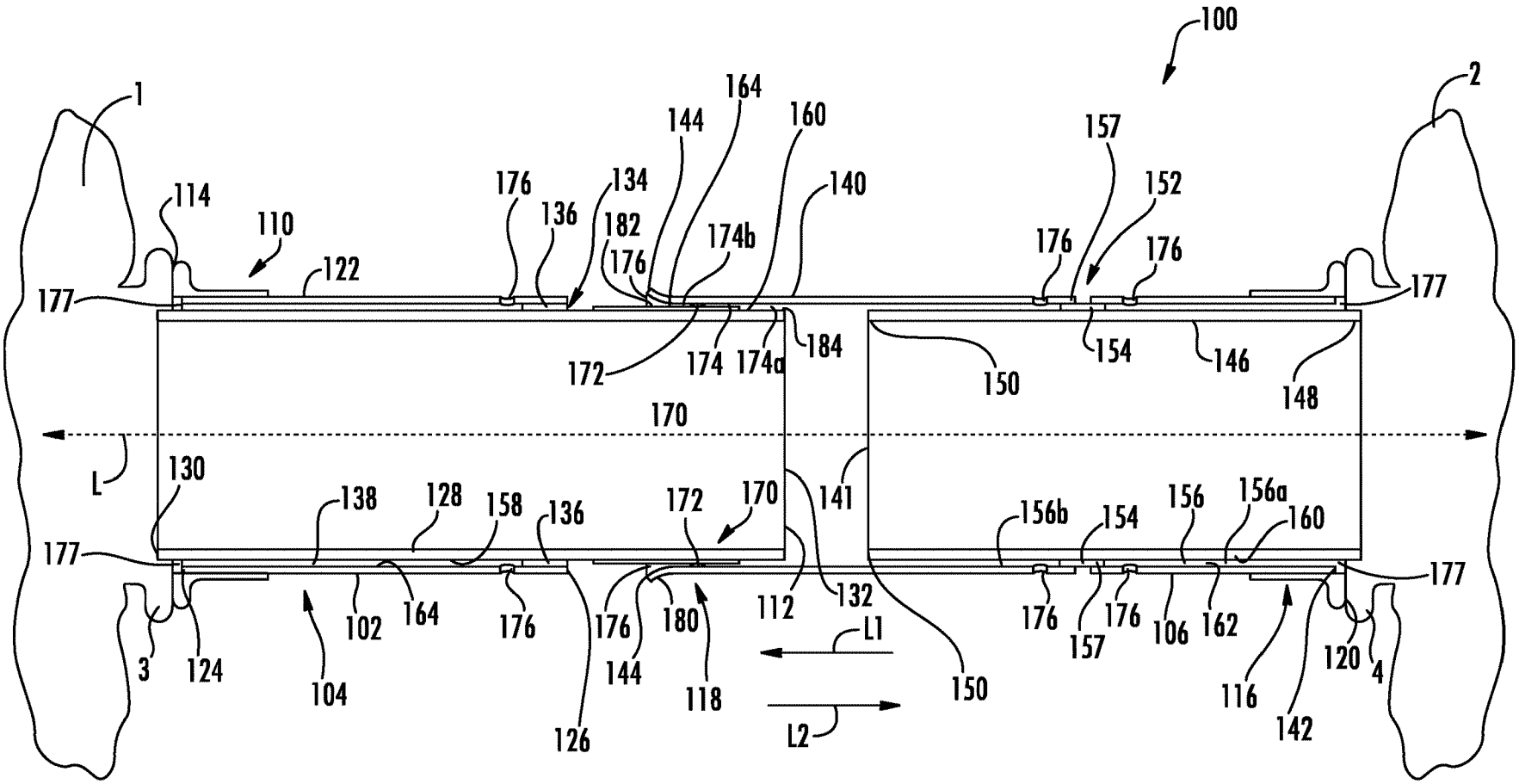
FIG. 1B is a longitudinal cross-section view of the cross-flame duct of FIG. 1A taken along section line 1B-1B of FIG. 1A.

In at least one embodiment, a cross-flame duct 100 may extend generally along a longitudinal axis L, as shown in FIGS. 1A and 1B. The cross-flame duct 100 may include a first duct 102 positioned at a first end 104 of the cross-flame duct 100 and a second duct 106 positioned at a second end 108 of the cross-flame duct 100. The first duct 102 may extend from a first end 110 to a second end 112. The first end 110 may be include a flange 114 for coupling the first end 104 of the cross-flame duct 100 to a first combustor 1 at a first combustor flange 3. The second duct 106 may extend from a first end 116 to a second end 118. The first end 116 may include a flange 120 for coupling the second end 108 of the cross-flame duct 100 to a second combustor 2 at a second combustor flange 4.

In one embodiment, one or both of the first and second flanges 114, 120 may be undersized with respect to a corresponding diameter of the combustor flange 3, 4 connection associated with the respective combustor 1, 2. The flange 114, 120 may allow the position of the cross-flame duct 100 with respect to the combustor flange 3, 4 to adjust for assembly tolerances. For example, the flange 114, 120 may be undersized with respect to an outer diameter of the respective combustor flange 3, 4 to allow the flanges 114, 120 to be repositioned within the outer diameter of the combustor flange 3, 4 to adjust for assembly tolerances. For example, ring-type compression clamps, e.g., "marmon" clamps, may be used to couple the respective flanges 114, 3, 120, 4. In at least one embodiment, a clamp or flange may be positioned over the outer diameters of the combustor flange 3, 4 and the flange 114, 120 of the cross-flame duct 100 to couple the respective flanges 114, 3, 120, 4 together.

In at least one embodiment, Interfacing areas of the outer sleeves 122, 140 and inner housings 128, 146 may be hard-face coated to minimize wear, and the inner housing ducts may include a thermal barrier coating (TBC) to protect against overheating. In various embodiments, the double wall configuration may enhance cooling efficiency compared to prior art systems. For example, the cross-flame duct 100 does not require use of a corrugated or other flex-type duct to compensate for assembly tolerances and other misalignment issues and may be formed form rigid components. Thus, whereas prior art designs require use of a flexible duct, such as a corrugated duct, between adjacent combustors to compensate for assembly tolerances, the cross-flame duct 100 is configured such that the first and second ends 110, 116 of the first and second ducts 102, 106 may be shifted up or down with respect to a respective combustor 1, 2 to enable the first and second ducts 102, 106 to operatively align when the combustors 1, 2 are axially misaligned. Such flexibility of the cross-flame duct 100 may be accomplished, at least, by the flanges 114, 120 of the cross-flame duct 100 being undersized relative to combustor flanges 3, 4 in which the flanges 114, 120 are to be coupled to compensate for assembly tolerances.

The cross-flame duct 100 may have any appropriate cross-sectional shape, such as, but not limited to, cylindrical, rectangular, square, triangular, and other multi or single sided configurations. In at least one embodiment, the cross-flame duct 100 may have a cylindrical configuration extending along the longitudinal axis L and may include an axial cross-section having an arcuate perimeter or circumference. In other embodiments, other arcuate or non-arcuate configurations may be used without departing from the beneficial features described here. For example, in one embodiment, a cross-flame duct 100 may includes an axial cross-section defining a multi-sided perimeter. The sides may include straight, curved or have other shapes.

In at least one embodiment, the first and second ducts 102, 106 may include modular components configured to interface or mate to form the cross-flame duct 100. For example, the first duct 102 may include a female end configured to receive a male end of the second duct 106. As described in more detail below, the first and second ducts 102, 106 may each include one or more subcomponents configured to form a double wall configuration along at least a portion of a length of each duct 102, 106. The various subcomponents of each of the first and second ducts 102, 106 may be coupled together with little, if any, risk of separation when the cross-flame duct 100 is assembled or installed for use. The double wall configuration provides a cooling system that regulates the temperature of the cross-flame duct 100 to reduce thermal stress and thermal gradients. Regulation of the temperature of the cross-flame duct 100 using the cooling system provided by the double wall configuration may also prevent material loss due to overheating or burning.

The first duct 102 and the second duct 106 may be configured to mate at their second ends 112, 118 to form a slip joint between the first and second ducts 102, 106. For example, as shown in FIGS. 1A and 1B, the second end 112 of the first duct 102 may include a male mating portion extending toward the second duct 106, and the second end 118 of the second duct 106 may include a female mating portion extending toward the first duct 102 and configured to receive the male mating portion of the first duct 102 therein. The second end 112 of the first duct 102 may have an outer diameter that is less than an inner diameter of the second end 118 of the second duct 106. To form the slip joint, the second end 112 of the first duct 102 may be received within the inner diameter or circumference of the second end 118 of the second duct 106. When mated, the first duct 102 and the second duct 106 may be relatively movable via longitudinal sliding along the slip joint. The longitudinal sliding may allow the cross-flame duct 100 to compensate for thermal expansion.

The first duct 102 may include a first outer sleeve 122 having a first end 124 and a second end 126 and a first inner housing 128 having a first end 130 and a second end 132. The first inner housing 128 may have an outer diameter that is less than an inner diameter of the first outer sleeve 122. A first cooling chamber 138 may be positioned between the first outer sleeve 122 and the first inner housing 128. The first cooling chamber 138 may include one or more fluid ports 176 forming cooling fluid inlets and one or more outlets 177 exhausting the cooling fluid into the combustor 1 for combustion. The first cross-flame duct 100 may include one or more standoffs 134 positioned between the first inner housing 128 and the first outer sleeve 122 to maintain the position of the first inner housing 128 within the first outer sleeve 122 and to maintain the first cooling chamber 138. In at least one embodiment, the standoff 134 may be formed from one or more spacers 136 that assist in forming the first cooling chamber 138 defined between the first inner housing 128 and the first outer sleeve 122. The standoff 134 may be a fixed standoff 134 including one or more fixed spacers 136 with respect to the first inner housing 128 and first outer sleeve 122.

The second duct 106 may include a second outer sleeve 140 having a first end 142 and a second end 144 and a second inner housing 146 having a first end 148 and a second end 150. The second inner housing 146 may include an outer diameter that is less than an inner diameter of the second outer sleeve 140. A second cooling chamber 156 may be positioned between the second outer sleeve 140 and the second inner housing 146. The second cooling chamber 156 may include one or more fluid ports 176 forming cooling fluid inlets and one or more outlets 177 exhausting the cooling fluid into the combustor 2 for combustion. The second cross-flame duct 100 may include one or more standoffs 152 positioned between the second inner housing 146 and the second outer sleeve 140 to maintain the position of the second inner housing 146 within the second outer sleeve 140 and to maintain the second cooling chamber 156. In at least one embodiment, the standoff 152 may be formed from one or more spacers 154 configured to maintain the second cooling chamber 156 defined between the second inner housing 146 and the second outer sleeve 140. The standoff 152 may be formed from a fixed standoff 152 including one or more fixed spacers 154 with respect to the second inner housing 146 and second outer sleeve 140.

As described below, the standoffs 134, 154, may be, but are not limited to being, rings or dimples, and may be function as a spacer that ensures a consistent space is maintained between the outer sleeves 122, 140 and inner housings 128, 146 for even cooling. In at least one embodiment, the standoffs 134, 154 may be used to position the inner housings 128, 146 concentrically within the outer sleeves 12, 140. In other embodiments, the standoffs 134, 154 may position the inner housings 128, 146 eccentrically within the outer sleeves 12, 140.

In various embodiments, the fixed spacers 136, 154 may include attachment points between either the first inner housing 128 and the first outer sleeve 122 or between the second inner housing 146 and second outer sleeve 146. Such spacers 136, 154 may include, but are not limited to, radially extending projections, rings, collars, tabs, or the like, configured to separate the first or second outer sleeve 122, 140 from the first or second inner housing 128, 146. The spacers 136, 154 may extend about a perimeter of the first or second inner housing 128, 146 along an outer surface 158, 160, and along the first or second outer sleeve 122, 146 along an inner surface 162, 164. In at least one embodiment, one or more fluid ports may extend through a spacer 136, 154 to provide a fluid pathway into the first and second cooling chambers 138, 156 from an environment outside of the cross-flame duct 100 or the first or second outer sleeves 122, 146.

In at least one embodiment, the spacers 136, 154 may be formed from annular rings extending circumferentially between outer surfaces 158, 160 of the first and second inner housings 128, 146 and the inner surfaces 162, 164 of the first and second outer sleeve 122, 146. The first duct 102 may include a standoff 134 including a fixed spacer 136 extending between and in contact with the first outer sleeve 122 and the first inner housing 128. The spacer 136 may be an annular ring extending between the outer surface 158 of the first inner housing 128 and the outer surface 160 of the first outer sleeve 122. In one configuration, the spacer 136 may be attached to the first outer sleeve 122 and the first inner housing 128 via a weld. The second duct 106 may include a standoff 152 including a fixed spacer 154 extending between and in contact the second outer sleeve 140 and the second inner housing 146. The second outer sleeve 140 and the second inner housing 146 may also be attached to the spacer 154 via a weld.

As shown in FIGS. 1A and 1B, the second outer sleeve 140 may include a first portion 140*b* and a second portion 140*a* that may be attached to the spacer 154 via a weld, such as a plugweld about a surface of the spacer 154. The spacer 154 may also subdivide the second cooling chamber 156 into a first cooling subchamber 156*a* and a second cooling subchamber 156*b*. The first and second cooling subchambers 156*a*, 156*b* may be fluidically coupled, e.g., via fluid ports 157 in the spacer 154 or between multiple spacers 154. In the illustrated embodiment, however, the spacer 154 does not include fluid ports and the first and second cooling subchambers 156*a*, 156*b* are not fluidically coupled through such fluid ports.

In at least one embodiment, as shown in FIGS. 1A and 1B, the second end 144 of the second outer sleeve 140 may extend beyond the second end 150 of the second inner housing 146 and may include a female portion configured to receive the male portion of the first duct 102. The second end 144 of the second outer sleeve 140 may be configured to slidably receive the second end 132 of the first inner housing 128 to form the slip joint to allow relative movement between the first duct 102 and the second duct 106. When the second end 132 of the first inner housing 128 is received by the second end 144 of the second outer sleeve 140, a third cooling chamber 174 is formed between the outer surface 160 of the second end 132 of the first inner housing 128 and the inner surface 164 of the second end 144 of the second outer sleeve 140. One or more standoffs 170 may be positioned along the outer perimeter of the first inner housing 128 and the inner perimeter of the second outer sleeve 140. The standoff 170 may be provided to radially offset the second end 144 of the second outer sleeve 140 from the second end 132 of the first inner housing 128. The standoff 170 may be formed from one or more spacers 172 configured to maintain a third cooling chamber 174. In at least one embodiment, the third cooling chamber may have a consistent width. The spacers 172 may be formed on the first inner housing 122 or the second outer sleeve 140 and may include rings, collars, radial projections, or the like.

As shown in FIGS. 1A and 1B, a plurality of spacers 172 including dimples may be formed on the second duct 106 about its perimeter. While the one or more spacers 172 may be positioned on either or both of the first inner housing 128 or second outer sleeve 140, a plurality of spacers 172 may be positioned on an inner surface 164 of the second outer sleeve 140 and may be configured to slidably contact the adjacent outer surface 158 of the first inner housing 128. As such, the standoff 170 may be a dynamic standoff 170 formed from one or more dynamic spacers 172 configured to maintain a third cooling chamber 174 with a consistent width that may enable generally longitudinal movement between the first duct 102 and second duct 106 and a corresponding change in a longitudinal length of the third cooling chamber 174.

When multiple spacers 172 are provided, the spacers 172 may be positioned at intervals or as otherwise needed. The spacers 172 may be arranged such that fluid ports 176 or fluid paths are defined therebetween to allow fluid to flow from the exterior environment into the third cooling chamber 174. In at least one embodiment, one or more spacers 172 may include an annular ring or collar. The annular ring or collar may provide a full or partial seal between the first and second ducts 102, 104. In some such embodiments, one or more fluid ports 176 may be defined in the second outer sleeve 140 adjacent the spacer 172. In one embodiment, various fluid ports 176 are defined between spacers 172 to provide an inlet fluid path between an exterior environment and the third cooling chamber 174. As shown in FIGS. 1A and 1B, the spacers 172 may include one or more dimples formed in the second outer sleeve 140. The spacers 172 may have any appropriate shape, such as, but not limited to, any geometric, non-geometric, regular, or irregular shape.

As shown in FIGS. 1A and 1B, the second end of the second outer sleeve 140 may be a flared lip 180, which may further increase cooling or fluid flow. In one embodiment, the second end 144 of the second outer sleeve 140 may extend to or be slidably extendable to the second end 126 of the first outer sleeve 122 along the outer surface 158 of the first inner housing 128. In another configuration, the second outer sleeve 140 may slidably receive the second end 126 of the first outer sleeve 122 to form a triple wall configuration along a portion of the cross-flame duct 100. The spacers 172 may be positioned such that the third cooling chamber 174 is divided into two fluidically coupled third cooling subchambers 174*a*, 174*b*. The second cooling subchamber 174*b* may include an inlet 182, forming a fluid port 176, from the exterior environment to the second cooling chamber 174*b*. The first subchamber 174*a* may include an outlet 184 to the inner aspects of the cross-flame duct 100. In at least one embodiment, however, the spacers 172 may be provided such that only a third cooling chamber 174 is provided along the interface of the first and second ducts 102, 106.

One or more fluid ports 176 may be positioned in the first or second ducts 102, 106 to provide fluid pathways between the exterior environment of the first or second outer sleeve 122, 140 and the first, second and third cooling chambers 138, 156, 174 defined between the inner housing 128, 146 and the outer sleeve 122, 140. For example, differential pressure may drive gas flow from an exterior environment into the first, second and third cooling chambers 138, 156, 174, e.g., drive flow of cooler shell air into the duct. The cooling fluid may be exhausted from the first, second and third cooling chambers 138, 156, 174 into the inner chambers within the inner housings 128, 146 and into the combustors 1, 2. First and second outer sleeves 122, 140 may include one or more fluid ports 176. Such fluid ports 176 may be radially oriented with respect to the cross-flame duct 100.

In at least one embodiment, each first, second and third cooling chamber 138, 156, 174 may each include at least one fluid port 176 or fluid path to couple the first, second and third cooling chambers 138, 156, 174 with the exterior environment, e.g., cooling air flow. In various embodiments, the first and second cooling chambers 138, 156 adjacent to a flange 114, 120 or combustor 1, 2 may include outlets 177 to the combustor 1, 2, combustor flange 3, 4, or associated combustion path to reduce overheating of the respective flanges 114, 120 and ducts 102, 106 in the flange area.

Figure 2A:
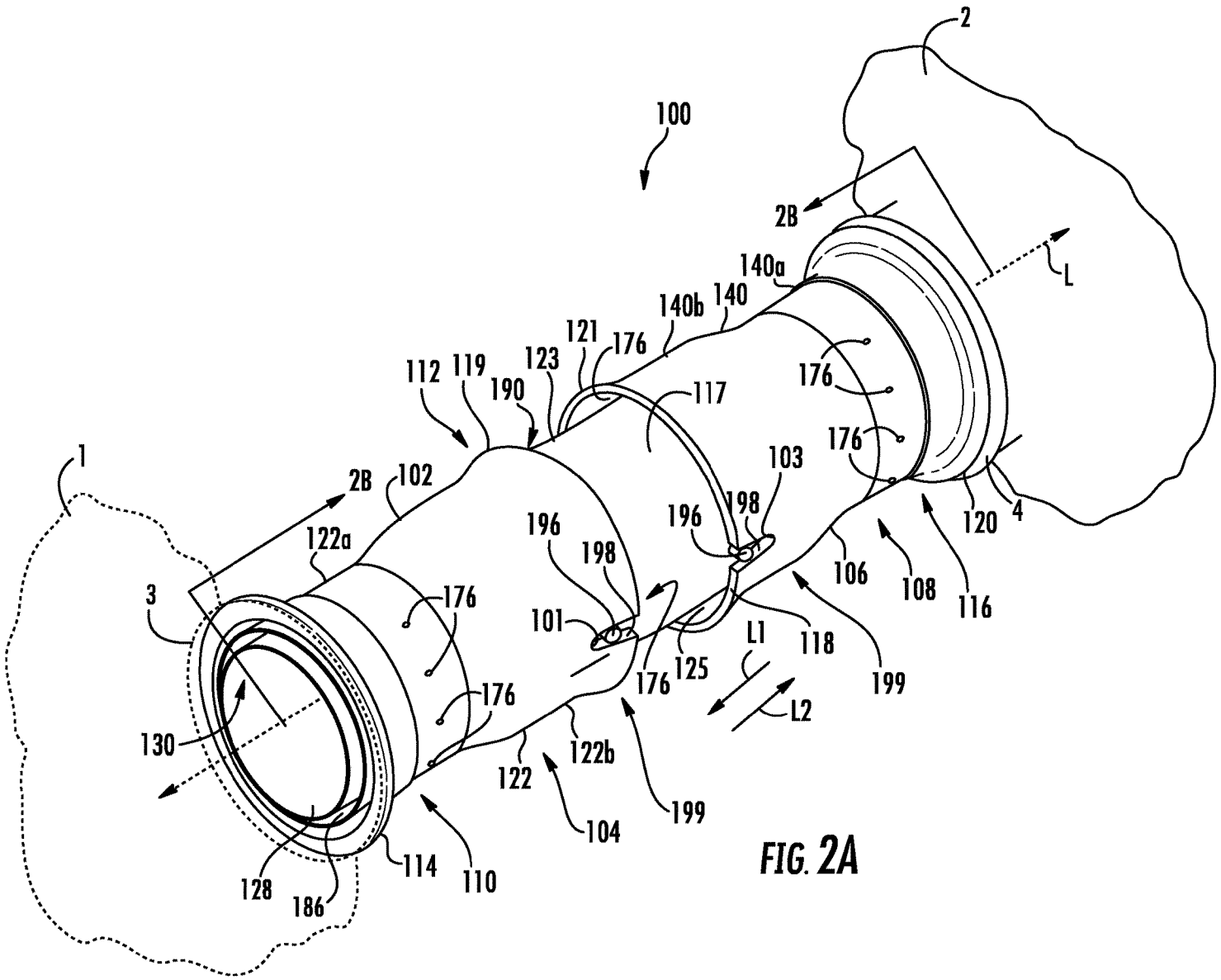
FIG. 2A is a perspective view of another embodiment of a cross-flame duct according to various embodiments described herein.
Figure 2B:
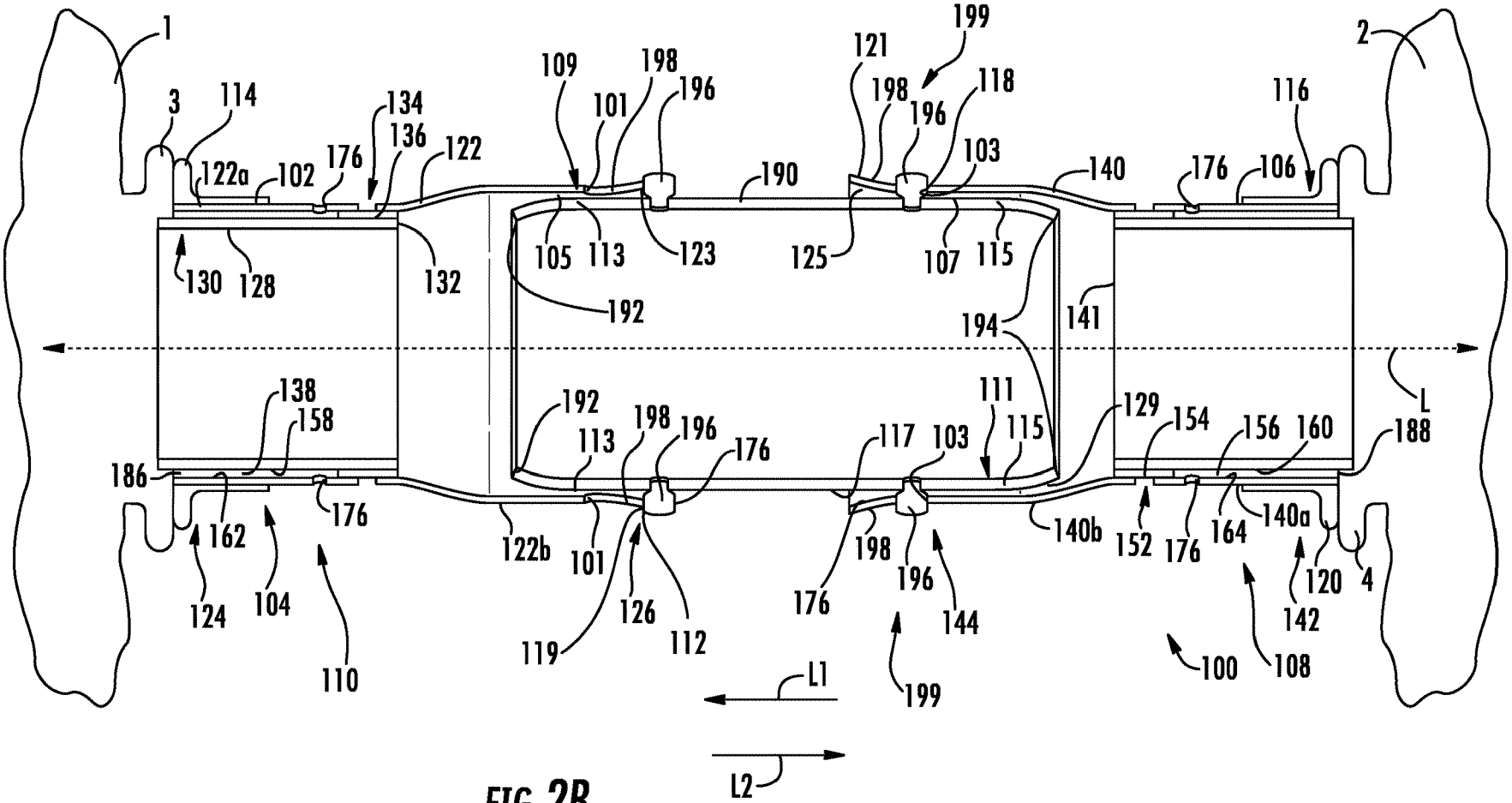
FIG. 2B is a longitudinal cross-section view of the cross-flame duct of FIG. 2A taken along section line 2B-2B of FIG. 2A.
Figure 3:
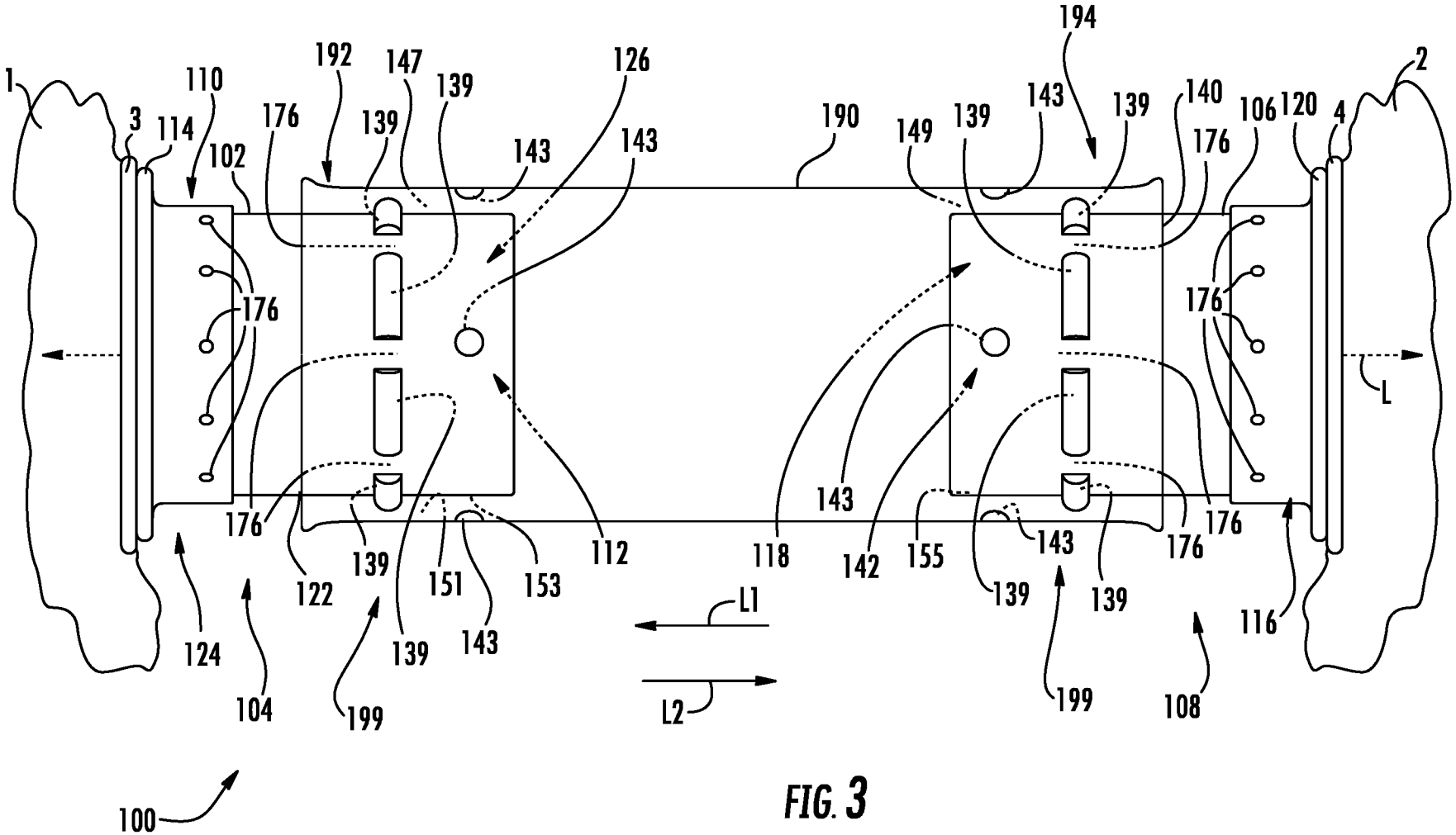
FIG. 3 is a perspective view of yet another embodiment of a cross-flame duct in which the third duct is shown partially transparent according to various embodiments described herein.

As shown in FIGS. 2A-3, the cross-flame 100 duct may include a third duct 190. The third duct 190 may be configured to be movably associated with respect to the first duct 102 or the second duct 106, or both. The third duct 190 may couple the first and second ducts 102, 106 together. For example, the third duct 190 may include a first end 192 configured to receive or be received by the first duct 102 and a second end 194 configured to receive or be received by the second duct 106. In one embodiment, as shown in FIGS. 2A and 2B, the third duct 190 may include two male ends configured to be received by female ends of each of the first and second ducts 102, 106. In another embodiment, as shown in FIG. 3, the third duct 190 may include two female ends configured to receive a male end of each of the first and second ducts 102, 106. In other embodiments, the third duct 190 may include a male end configured to be received by a female end of the first duct 102 and a female end configured to receive a male end of the second duct 106, or vice versa. In at least one embodiment, the first duct 102, the second duct 106, and third duct 190 may be configured for relative movement such that the first component 102 may move relative to the second duct 106 or the third component 190, or both, and the second duct 106 and the third component 190 may move relative to each other.

As shown in FIGS. 2A and 2B, the cross-flame duct 100 may include a third duct 190 having a first end 192 and a second end 194. The third duct 190 may be a free floating middle duct that provides additional flexibility. The position of the third duct 190 may be controlled with one or more pins 196 positioned within slots 198 that limit rotation of the third duct 190 and limit floatable movement along the longitudinal axis L. A hard-face coating and TBC, for example, may be used similar to the embodiment described above with respect to FIGS. 1A & 2B. A double wall configuration for cooling and dimples may similarly be employed.

The cross-flame duct 100 may include a first duct 110 positioned at a first end 104 of the cross-flame duct 100 and a second duct 106 positioned at a second end 108 of the cross-flame duct 100. The first duct 110 may extend from a first end 110 to a second end 112. The first end 110 may be configured to include a flange 114 for coupling the first end 104 of the cross-flame duct 100 to the first combustor 1. The second duct 106 may extend from a first end 116 to a second end 118. The first end 116 may be configured to include a flange 120 for coupling the second end 108 of the cross-flame duct 100 to the second combustor 2.

The cross-flame duct 100 may further include the third duct 190. The third duct 190 may be configured to mate with the first duct 110 and the second duct 106 to form a slip joint therebetween. When mated to the first and second ducts 110, 106, the third duct 190 may be configured for generally longitudinal movement relative to one or both of the first and second ducts 110, 106. The third duct 190 may be coupled to the first duct 110 and the second duct 106 such that the third duct 190 may float between the two from a first longitudinal position, in direction of L1, to a second longitudinal position, in direction of L2. For example, the second end 112 of the first duct 110 may be configured to mate with a first end 192 of the third duct 190 and the second end 118 of the second duct 106 may be configured to mate with a second end 118 of the third duct 190.

A shown in FIGS. 2A & 2B, the second end 112 of the first duct 110 may include a female coupling configured to receive the first end 192 of the third duct 190, which may include a male coupling. The second end 118 of the second duct 106 may also include a female coupling and be configured to receive the second end 194 of the third duct 190, which may include a male coupling. The second ends 112, 118 of the first and second ducts 110, 106 may include inner diameters greater than an outer diameter of the first end 192 and the second end 194 of the third duct 190. To form the slip joint, the second end 112 of the first duct 110 may receive the first end 192 of the third duct 190 within its inner diameter, and the second end 118 of the second duct 106 may receive the second end 194 of the third duct 190 within its inner diameter. When mated, the first duct 110 and the second duct 106 may slide longitudinal, and the third duct 190 may float therebetween. The longitudinal sliding or floating may allow the cross-flame duct 100 to compensate for thermal expansion during operation of the gas turbine.

As introduced above, the third duct 190 is configured to float between the first and second ducts 110, 106 between a first longitudinal position, in direction of L1, and a second longitudinal position, in direction of L2. The distance along which the third duct 190 may longitudinally float may be defined between a first stop 101 and a second stop 103. While any manner of defining the longitudinal distance or range that the third duct 190 may float may be used, in the illustrated embodiment, a position control system 199 may be used to limit movement. In at least one embodiment, the position control system 199 may be formed from one or more pins 196 positioned within one or more slots 198. In particular, the first end 192 and second end 194 of the third duct 190 may each include at least one pin 196, and the second ends 112, 118 of the of the first and second ducts 110, 106 each may include at least one slot 198 configured to receive a pin 196. The distance or range the third duct 190 may float toward the first position in direction L1 is limited by the first stop 101 and the distance the third duct 190 may float toward the second position in direction L2 is limited by the second stop 103. Each slot 198 may include a stop 101, 103 to limit translation of the pin 196 and hence the longitudinal distance in which the third duct 190 may float in directions L1 and L2. Each slot 198 may include one or more stops 101, 103 or stops 101, 103 may be provided in less than all the slots 198. As shown in FIGS. 2A and 2B, the third duct 190 is in the second position, in direction of L2, as the pins 196 have reached the second stop 103 positioned at the end of the at least one slot 198 of the second duct 106.

The cross-flame duct 100 may be configured such that one or both of the first ends 110, 116 of the first and second ducts 110, 106 may be shifted up or down with respect to a respective combustor 1, 2 to enable the cross-flame duct 100 to line up with the combustors 1, 2, for example, when the combustors 1, 2 or associated fittings are axially misaligned. As explained above, for example, the cross-flame duct 100 may include flanges 114, 120 that are undersized to compensate for assembly tolerances.

As shown in FIGS. 2A and 2B, when the second end 126 of the first outer sleeve 122 may receive the first end 192 of the third duct 190, a third cooling chamber 105 may be positioned between the outer perimeter of the second end 132 of the first inner housing 128 and the first end 192 of the third duct 190. When the second end 144 of the second outer sleeve 140 receives the second end 194 of the third duct 190, a fourth cooling chamber 107 may be positioned between the outer perimeter of the second end 150 of the second inner housing 146 and the second end 194 of the third duct 190. The first end 130 of the first inner housing 128 and the first end 150 of the second inner housing 146 may extend along the longitudinal axis to a position beyond the first ends 124, 144 of the first and second outer sleeves 122, 140 and the flanges 114, 120. In various embodiments, the first and second cooling chambers 138, 156 may be positioned between the inner housings 128, 146 and the outer sleeves 122, 140 may open into the combustor 1, 2 or associated fitting at one first end and extend to the spacer 136, 154 at a second end.

The second ends 126, 144 of the first and second outer sleeves 122, 140 may extend beyond the second end 132, 141 of the first and second inner housings 128, 146 and may include female portions configured to slidably receive the male portions positioned at the first and second ends 192, 194 of the third duct 190 such that the third duct 190 may longitudinally float therebetween as defined by the limiters. Standoffs 109, 111 may be positioned along the outer perimeters of the first and second ends 192, 194 of the third duct 190 and the inner perimeters of the second ends 126, 144 of the first and second outer sleeves 122, 140. The standoffs 109, 111 may be formed from one or more spacers 113, 115 configured to maintain the third and fourth cooling chambers 105, 107. While the one or more spacers 113, 115 may be positioned on either or both of the third duct 190 and the first and second outer sleeves 122, 140, in FIGS. 2A and 2B, the spacers 113, 115 may be positioned on outer surface 117 of the third duct 190 along the first and second ends 192, 194 and may be configured to slidably contact the adjacent inner surfaces 162, 164 of the first and second outer sleeves 122, 140. As such, the standoffs 109, 111 may be formed from dynamic standoffs 109, 111 that include one or more dynamic spacers 113, 115 configured to maintain a third and fourth cooling chambers 105, 107 while also permitting floatable longitudinal movement of the third duct 190 between a first position, in direction of L1, and a second position, in direction of L2, expansion of the first and second ducts 110, 106, and corresponding changes in a longitudinal length of the annulus spaces 105, 107 maintained by the spacers 113, 115. When multiple spacers 113, 115 are provided, the spacers 113, 115 may be positioned at intervals or as otherwise needed. In at least one embodiment, the one or more spacers 113, 115 may be formed from an annular ring or collar. The annular ring or collar may provide a full or partial seal between the first and second ducts 110, 106. In some such embodiments, one or more fluid ports may be defined in the outer sleeve 122, 140, e.g., adjacent to a spacer 113, 115. As shown in FIGS. 2A and 2B, the spacers 109, 111 may include one or more conical or arcuate dimples formed on the first and second ends 192, 194 of the third duct 190. The dimples may include engagement surfaces configured for limited surface area contact with adjacent surfaces. In various embodiments, the spacers 109, 111, e.g., dimples, may have any geometric, non-geometric, regular, or irregular shape. The spacers may be positioned at intervals to enable fluid ports to be positioned therebetween.

The second ends 126, 144 of the first and second outer sleeves 122, 140 may include flared lips 119, 121, which may further increase cooling or fluid flow available to the first and second portions. Similar to the embodiment described above with respect to FIGS. 1A & 2B, when the third duct 190 is received by the second ends 126, 144 of the first and second outer sleeves 122, 140, third and fourth cooling chambers 105, 107 may be defined between the outer surface 117 of the third duct 190 and the inner surfaces 162, 164 of the second ends 126, 144 of the first and second outer sleeves 122, 140. Standoffs 109, 111 including spacers 113, 115, as described above, may be provided to standoff the second ends 126, 144 from the third duct 190. Each of the third and fourth cooling chambers 105, 107 may include an inlet 123, 125 that is open to the exterior environment and an outlet 127, 129 that is open to the inner aspects of the cross-flame 100. In at least one embodiment, however, the spacers 113, 115 may be provided such that only a single third or fourth cooling chamber 105, 107 is provided along the interface of the first and second ducts 110, 106 and the third duct 190.

The second ends 126, 144 of the first and second outer sleeves 122, 144 may extend beyond the second ends 132, 150 of the first and second inner housings 128, 146. Along this portion, the outer sleeves 122, 140 may flare outwardly to increase and increase in volume to accommodate the third duct 190. For example, as shown in FIGS. 2A and 2B, the second outer sleeve 140 may include a first portion 140*a* and a second portion 140*b* that may be attached to the spacer 154, e.g., via a weld. In one embodiment, the first or second outer sleeve 122, 140 may include fewer or more portions and is not limited in this respect. The first outer sleeve 122 may also include a first portion 122*a* and a second portion 122*b* that may be attached to the spacer 136, e.g., via a weld. In at least one embodiment, the section portion 122*b* may have a larger inner diameter than an inner diameter of first portion 122*a*. In other embodiments, the outer sleeves 122, 140 may not be flared. The first and second ends 192, 194 of the third duct 190 are also depicted to decrease in diameter, however, in at least one embodiment, the first and second ends 192, 194 may maintain a consistent diameter.

Similar to the cross-flame duct 100 of FIGS. 2A & 2B, the cross-flame duct 100 shown in FIG. 3 also includes a third duct 190. The third duct 190 may be configured to float between a first longitudinal position, in direction of L1, and a second longitudinal position, in direction of L2. The extent the third duct 190 may float may be defined by a limiter configuration similar to the embodiments described above with respect to FIGS. 2A & 2B. For example, one or more pins 196 and slots 198 may be used to prevent or define rotation of the third duct 190 and limit or define its movement along the longitudinal axis L. As shown in FIG. 3, standoffs 131, 133 each include one or more spacers 139 to form third and fourth cooling chambers 147, 149. The third and fourth cooling chambers 147, 149 may have any appropriate configuration. In at least one embodiment, the third and fourth cooling chambers 147, 149 may be concentric with the third duct 190. The spacers 139 may limit the longitudinal distance the third duct 190 may float. The third duct 190 may also be configured for floatable rotation. Hard-face coating and TBC, for example, may be used similar to the embodiments described above with respect to FIGS. 1A-2B.

The first and second ducts 102, 106 of the cross-flame duct 100 may be similar to the first and second ducts 102, 106 of the embodiments described above with respect to FIGS. 1A-2B in that the first and second ducts 102, 106 of FIG. 3 may also include the double wall configuration. Thus, each of the first and second ducts 102, 106 may each include an outer sleeve 122, 140 and an inner housing 128, 146 (not visible) that define at least one first and second cooling chamber 138, 156 (not visible). Similar to FIGS. 1A-2B, one or both of the first and second flanges 114, 120 may be undersized with respect to the combustor flange 3, 4 to which it is to connect to allow for compensation for assembly tolerances.

The third duct 190 may form a double wall configuration for additional cooling with standoffs 131, 133 formed from spacers 139, 143 positioned between the inner surface 151 of the third duct 190 and outer surfaces 153, 155 of the first and second ducts 102, 106. The spacers 139, 143 may be configured to move relative to an adjacent surface to maintain an annulus space 147, 149 between the inner surface 151 of the third duct 190 and both the outer surfaces 153, 155 of the first and second outer sleeves 122, 140. The second ends 126, 144 of the first and second outer sleeves 122, 140 may include male portions configured to slidably receive female portions positioned of the third duct 190 positioned at its first and second ends 192, 194 such that the third duct 190 may longitudinally float therebetween with respect to the longitudinal axis L. The third duct 190 may also be rotatable about the outer perimeters of the first and second outer sleeves 122, 140. In other embodiments, however, rotation may be limited, e.g., by a pin and slot configuration as described above, or by guidable floating of the spacers 139, 143 through grooves defined in a surface of the ducts 102, 106, 190, which may include grooves defined by or between spacers 139, 143.

The spacers 139, 143 may be positioned at intervals or as otherwise needed. In at least one embodiment, the spacers 139, 143 may include an annular ring or collar. In at least one embodiment, one or more fluid ports 176 may be defined between adjacent spacers 139, 143 or grooves formed at the outer surface 117 of the third duct 190 or inner surface 162, 164 of the first or second outer sleeve 122, 140. As shown in FIG. 3, the first and second outer sleeves 122, 140 may include spacers 139 formed from radially extending ridges positioned at intervals along the outer perimeter of the first and second outer sleeves 122, 140. However, in various embodiments, the spacers 139 may have any geometric, non-geometric, regular, or irregular shape.

When the third duct 190 receives the first and second outer sleeves 122, 140, fluid ports 176 may be defined between the spacers 139. The fluid ports 176 may be longitudinally oriented, as shown in FIG. 3, to provide general longitudinal fluid flowpaths for passage of cooling fluid. In at least one embodiment, the spacers 139 may be positioned in multiple rows or columns to define third and fourth cooling chambers 147, 149 and fluid ports 176. In at least one embodiment, a fluid port 176 may be defined through the third duct 190. The third and fourth cooling chambers 147, 149 may be include at least one inlet to receive a cooling fluid, such as, but not limited to air, from the exterior environment, e.g., the third and fourth cooling chambers 147, 149 may be in fluid communication with the exterior environment to cooling air flow through a fluid port 176. The first and second ends 192, 194 of the third duct 190 may also be flared for increased fluid availability. In at least one embodiment, differential pressure may drive gas flow from an exterior environment into the third and fourth cooling chambers 147, 149, e.g., drive flow of cooler shell or casing air into the cross-flame duct 100. The cooling air may pass through the third and fourth cooling chambers 147, 149 and into the combustors 1, 2.

As shown in FIG. 3, the cross-flame duct 100 may include a position control system 199 for limiting movement of the third duct 190 relative to the first and second ducts 102, 106. In at least one embodiment, the third duct 190 may include radially extending spacers 143 having a dimple form. However, in various embodiments, the spacers 143 may have any geometric, non-geometric, regular, or irregular shape. Fewer or additional spacers 143 may also be provided. Whereas the cross-flame duct 100 of FIGS. 2A & 2B includes a pin and slot arrangement to limit the longitudinal distance the third duct 190 may float, the cross-flame duct 100 shown in FIG. 3 may limit longitudinal floatation of the third duct 190 using the spacers 139, 143. For example, the third duct 190 in FIG. 3 is illustrated in a mid-position between a first position, in direction of L1, toward the first end of the first duct 102 and a second position, in direction of L2, toward the first end of the second duct 106. The fluid ports 176 defined between the ridge shaped spacers 139 are dimensioned to prevent passage of the dimple shaped spacers 143. Thus, when the third duct 190 floats toward the first position, in direction L1, the dimple shaped spacers 143 formed on the first end 192 of the third duct 190 engage the ridge shaped spacers 139 defined on the first duct 102 to prevent further longitudinal floatation of the third duct 190 toward the first end 110 of the first duct 102. Similarly, when the third duct 190 floats toward the second position, in direction of L2, the dimple shaped spacers 143 formed on the second end 194 of the third duct 190 are configured to engage the ridge shaped spacers 139 defined on the second duct 106 to prevent further longitudinal floatation of the third duct 190 toward the first end 116 of the second duct 106.

The spacers 139, 143 may be positioned on either or both of the third duct 190 or the first and second outer sleeves 122, 140. As shown in FIG. 3, the spacers 139, 143 may be positioned on the inner surface 151 of the third duct 190, along the first and second ends 192, 194, and the outer surface 153, 155 of each of the first and second outer sleeves 122, 140. The spacers 139, 143 may be configured to slidably contact the adjacent inner or outer surfaces 151, 153, 155. As such, the standoffs 131, 133 and associated spacers 139, 143 may be dynamically configured to maintain third and fourth cooling chambers 147, 149. In at least one embodiment, the spacers 139, 143 may maintain consistent width third and fourth cooling chambers 147, 149 in a dynamic environment that includes floatable longitudinal movement of the third duct 190 between a first position, in direction of L1, and a second position, in direction of L2, expansion of the first and second ducts 102, 106, and corresponding changes in a longitudinal length of the third and fourth cooling chambers 147, 149.

The outer and inner diameters of the interfacing portions of the first, second, and third ducts 102, 106, 190 or the standoffs 131, 133 may be dimensioned to provide various sized annulus spaces 147, 149 and to control fitment. For example, the cross-flame duct 100 shown in FIG. 3 may include dimple shaped spacers 143 and ridge shaped spacers 139 having arcuate dimensions for engagement with adjacent surfaces of the second ends 126, 144 of the first and second outer sleeves 122, 140 and the first and second ends 192, 194 of the third duct 190. The dimple shaped spacers 143 may extend a radial distance into the third and fourth cooling chambers 147, 149 that is less than the radial distance that the ridge shaped spacers 139 extend into the third and fourth cooling chambers 147, 149. Thus continuous engagement between the dimple shaped spacers 143 and the adjacent outer surfaces 153, 155 of the second ends 126, 144 of the first and second outer sleeves 122, 140 may not be required. As shown in FIG. 3, the fitment of the third duct 190 with the first and second outer sleeves 122, 140 may allow the third duct 190 to be offset to provide mechanical play with respect to the alignment of the first duct 102 and the second duct 106. For example, radial misalignment between the first duct 102 and the second duct 106 may cause the inner surface 151 of the third duct 190 to roll along the arcuate engagement surfaces of the ridge shaped spacers 139 until the clearance between one or more dimple shaped spacers 143 and the adjacent outer surface 153, 155 of the first or second outer sleeve 122, 140 is reduced such that one or more dimple shaped spacers 143 engage the outer surface 153, 155. Even when the third duct 190 is offset such that one or more dimple shaped spacers 143 are engaged with the adjacent surface 153, 155 of the outer sleeve 122, 144, a consistent minimum radial distance and volume of the annulus space 147, 149 is maintained. The outer diameters of the first and second outer sleeves 122, 140 or the inner diameters of the first and second ends 192, 194 of the third duct 190 may also be modified to increase or decrease the tightness of the fit along the slip joint to control the floatability of the third duct 190 or available mechanical play with respect to the alignment of the first and second ducts 102, 106.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A cross-flame duct for connecting adjacent combustors in a gas turbine engine, comprising:

a first duct extending along a longitudinal axis and configured to be coupled to a first combustor, the first duct comprising:

a first outer sleeve having a first end configured to be coupled to the first combustor and a second end on an opposite end from the first end, and a first inner housing positioned within the first outer sleeve and having a first end adjacent the first combustor and a second end extending from the second end of the first outer sleeve;

a first cooling chamber positioned between an outer surface of the first inner housing and an inner surface of the first outer sleeve; and a second duct extending along the longitudinal axis and configured to be coupled to a second combustor, wherein the second duct is configured to slidably receive the first duct, the second duct comprising:

a second outer sleeve having a first end configured to be coupled to the second combustor and extending toward the first duct to slidably receive the second end of the first inner housing within a second end of the second outer sleeve, a second inner housing positioned within the second outer sleeve and having a first end adjacent the second combustor and a second end extending toward the second end of the second outer sleeve;

a second cooling chamber positioned between an outer surface of the second inner housing and an inner surface of the second outer sleeve;

a first standoff positioned between the outer surface of the first inner housing and the inner surface of the first outer sleeve to maintain the first cooling chamber and a second standoff positioned between the outer surface of the second inner housing and the inner surface of the second outer sleeve to maintain the second cooling chamber; and a third cooling chamber positioned between the outer surface of the first inner housing and the inner surface of the second outer sleeve and a third standoff positioned between the outer surface of the first inner housing and the inner surface of the second outer sleeve, wherein the third standoff separates the second outer sleeve from the first inner housing to maintain and enable the first duct to slide relative to the second duct, wherein the third standoff comprises a plurality of spacers configured to slidably engage the outer surface of the first inner housing, the plurality of spacers arranged to permit longitudinal movement between the first duct and the second duct and a corresponding change in a longitudinal length of the third cooling chamber.

2. The cross-flame duct of claim 1, further comprising a first fluid port positioned in the first outer sleeve adjacent to the first standoff to allow fluid to flow between the first cooling chamber and an exterior environment.

3. The cross-flame duct of claim 2, further comprising a second fluid port positioned in the second outer sleeve adjacent to the second standoff to allow fluid to flow between the second cooling chamber and the exterior environment.

4. The cross-flame duct of claim 1, wherein the first outer sleeve comprises a first sleeve flange positioned at the first end of the first outer sleeve and the second outer sleeve comprises a second sleeve flange positioned at the second end of the second outer sleeve, wherein the first sleeve flange is configured to be coupled to a first combustor flange of the first combustor and the second sleeve flange is configured to be coupled to a second combustor flange of the second combustor, and wherein the first sleeve flange has an outer diameter that is less than an outer diameter of the first combustor flange.

5. The cross-flame duct of claim 1, wherein the first end of the first inner housing extends along the longitudinal axis toward the first combustor outwardly beyond the first end of the first outer sleeve.

6. The cross-flame duct of claim 1, wherein the second cooling chamber extends between the first end of the second inner housing and the second standoff, and wherein the third cooling chamber extends between the second end of the second inner housing and the second standoff.

7. A cross-flame duct for connecting adjacent combustors in a gas turbine engine, the cross-flame duct comprising:

a first duct extending along a longitudinal axis and configured to be coupled to a first combustor, the first duct comprising:

a first outer sleeve having a first end configured to be coupled to the first combustor and a second end on an opposite end from the first end, and a first inner housing positioned within the first outer sleeve and having a first end adjacent the first combustor and a second end on an opposite end from the first end;

a first cooling chamber positioned between an outer surface of the first inner housing and an inner surface of the first outer sleeve; and a second duct extending along the longitudinal axis and configured to be coupled to a second combustor, wherein the second duct is configured to slidably receive the first duct, the second duct comprising:

a second outer sleeve having a first end configured to be coupled to the second combustor and extending toward the first duct to slidably receive the second end of the first inner housing within a second end of the second outer sleeve, a second inner housing positioned within the second outer sleeve and having a first end adjacent the second combustor and a second end on an opposite end from the first end;

a second cooling chamber positioned between an outer surface of the second inner housing and an inner surface of the second outer sleeve; and a third duct comprising a first end slidably coupled to the second end of the first duct and a second end slidably coupled to the second end of the second duct, whereby the third duct forms a middle duct between the first and second ducts of the cross-flame duct, a third cooling chamber positioned between an outer surface of the third duct and the inner surface of the first outer sleeve and a fourth cooling chamber positioned between the outer surface of the third duct and the inner surface of the second outer sleeve.

8. The cross-flame duct of claim 7, wherein the second end of the first outer sleeve extends beyond the second end of the first inner housing and is configured to receive the first end of the third duct, and wherein the second end of the second outer sleeve extends beyond the second end of the second inner housing and is configured to receive the second end of the third duct.

9. The cross-flame duct of claim 7, further comprising a first standoff positioned between the outer surface of the first inner housing and the inner surface of the first outer sleeve to maintain the first cooling chamber and a second standoff positioned between the outer surface of the second inner housing and the inner surface of the second outer sleeve to maintain the second cooling chamber.

10. The cross-flame duct of claim 9, further comprising a third standoff and a fourth standoff, wherein the third standoff is positioned between the outer surface of the third duct and the inner surface of the first outer sleeve to maintain the third cooling chamber, and wherein the fourth standoff is positioned between the outer surface of the third duct and the inner surface of the second outer sleeve to maintain the fourth cooling chamber.

11. The cross-flame duct of claim 9, further comprising a first fluid port positioned in the first outer sleeve adjacent to the first standoff to allow fluid to flow into the first cooling chamber from an exterior environment, and further comprising a second fluid port positioned in the second outer sleeve adjacent to the second standoff to allow the fluid to flow into the second cooling chamber from the exterior environment.

12. The cross-flame duct of claim 10, wherein the third standoff and the fourth standoff each comprise a plurality of spacers positioned at the first end and second end of the third duct, respectively, the plurality of spacers are arranged to permit longitudinal movement between the first duct and the second duct and a corresponding change in a longitudinal length of the third cooling chamber.

13. The cross-flame duct of claim 12, further comprising a position control system for limiting the longitudinal movement of the third duct relative to the first and second ducts.

14. The cross-flame duct of claim 12, further comprising fluid ports positioned between the plurality of spacers to provide a fluid pathway between the third cooling chamber and an exterior environment and between the fourth cooling chamber and the exterior environment.

15. The cross-flame duct of claim 7, wherein the first outer sleeve comprises a first sleeve flange positioned at the first end of the first outer sleeve and the second outer sleeve comprises a second sleeve flange positioned at the first end of the second outer sleeve, wherein the first sleeve flange is configured to be coupled to a first combustor flange of the first combustor and the second sleeve flange is configured to be coupled to a second combustor flange of the second combustor, and wherein the first sleeve flange has an outer diameter that is less than an outer diameter of the first combustor flange.

16. The cross-flame duct of claim 7, wherein the first end of the third duct is configured to receive the second end of the first outer sleeve and wherein the second end of the third duct is configured to receive the second end of the second outer sleeve.

* * * * *